US006337670B1

(12) United States Patent
Chen

(10) Patent No.: US 6,337,670 B1
(45) Date of Patent: Jan. 8, 2002

(54) OMNI-DIRECTIONAL BROADBAND HELICAL ANTENNA ARRAY

(75) Inventor: I-Fong Chen, Tao-Yuan (TW)

(73) Assignee: Auden Technology Corp. Mfg. Co., Ltd. (TW)

( * ) Notice: Subject to any disclaimer, the term of this patent is extended or adjusted under 35 U.S.C. 154(b) by 0 days.

(21) Appl. No.: 09/670,566

(22) Filed: Sep. 27, 2000

(51) Int. Cl.[7] ..... H01Q 1/36; H01Q 1/38

(52) U.S. Cl. ..... 343/895; 343/700 MS; 343/853

(58) Field of Search ..... 343/895, 700 MS, 343/850, 852, 853, 858, 859, 860, 862, 864, 865; H01Q 1/36, 1/38

(56) References Cited

U.S. PATENT DOCUMENTS 4,680,591 A * 7/1987 Axford et al. ..... 343/895

5,345,248 A * 9/1994 Hwang et al. ..... 343/895

* cited by examiner

*Primary Examiner*—Hoanganh Le
(74) *Attorney, Agent, or Firm*—Dougherty & Troxell

(57) ABSTRACT

An omni-directional broadband helical antenna array having a square electric circuit board with the back side thereof grounded, wherein, the four orthogonal corners on the surface of the electric circuit board are provided each with a helical antenna. The distance between every two of the helical antennae is in the range of 0.25 λ–0.3 λ. The helical antennae feed signals outwardly via microstrip lines, the length of each of the microstrip lines is ¼λ; and they feed signals outwardly via another microstrip line after gathering the above mentioned microstrip lines. Thus an omni-directional broadband helical antenna device capable of mounting in a communication instrument such as a notebook style computer is formed.

9 Claims, 3 Drawing Sheets

OMNI-DIRECTIONAL BROADBAND HELICAL ANTENNA ARRAY

BACKGROUND OF THE INVENTION

1. Field of the Invention

The present invention is related to an omni-directional broadband helical antenna array, and especially to an antenna array which is suitable to be mounted in a communication instrument to form better omni-directional signal receiving and emitting functions under a complicated interior environment.

2. Description of the Prior Art

Coils used as signal receiving and emitting elements are well known, such coils can get their functions of various antennae by selecting related factors such as material, diameters, coil pitches and lengths. Modern communication instruments which most widely and popularly use helical antennae are mobile phones.

Such helical antennae available presently are mostly exposed. In other words, the helical antennae are mostly exposed to the outside of instruments; when in receiving and emitting signals, there is almost no impedance or influence. However, modern communication instruments carried on one's own such as notebook style computers also have communication functions and need antenna devices. Such built-in antennae in notebook style computers will have their signal receiving and emitting functions influenced by the complicated interior environments. For example, they may have no other electronic elements at one side thereof and can have desired signal receiving and emitting functions, but they may have electronic elements at the other side thereof and signal receiving and emitting functions thereof can be seriously influenced and gotten lost.

Although various microstrip antennae have been developed in the recent years, such as those disclosed in the U.S. Pat. No. 392,177 and 381,018, for improvement in getting rid of the impedance and deficient in using the antennae, such earlier microstrip antennae generally only suit narrower bandwidths. U.S. Pat. No. 07/695686 provides a preferred helical microstrip antenna which can solve the problems in the earlier microstrip antennae. However, such a helical microstrip antenna does not meet the requirement of ordinary miniaturized electronic equipment by virtue that the diameter of the antenna will be quite enlarged when in the condition of low frequency.

SUMMARY OF THE INVENTION

The object of the present invention is to provide an omni-directional broadband helical antenna array especially suitable for mounting in the interior of communication instruments, in order to provide better omni-directional signal receiving and emitting functions under the complicated interior environment.

To get the above stated object, the present invention provides on the four corners of a square electric circuit board each with a helical antenna. The helical antennae feed signals outwardly via microstrip lines, and they feed signals outwardly via another microstrip line after gathering the above mentioned microstrip lines. Thereby, the helical antenna array can form an omni-directional broadband receiving and emitting device.

The above stated helical antennae can separate the array into a plurality of sections with reflector such as copper sheets to increase the gain of the antennae.

To prevent disturbance among the antenna, distances between every two helical antennae had better be in the range of 0.25 λ–0.3 λ; while the length of the microstrip line as an impedance converter is about ¼ λ.

The present invention will be apparent in its novelty and other characteristics after reading the detailed description of the preferred embodiment thereof in reference to the accompanying drawings. Wherein:

DETAILED DESCRIPTION OF THE PREFERRED EMBODIMENT

Figure 1:
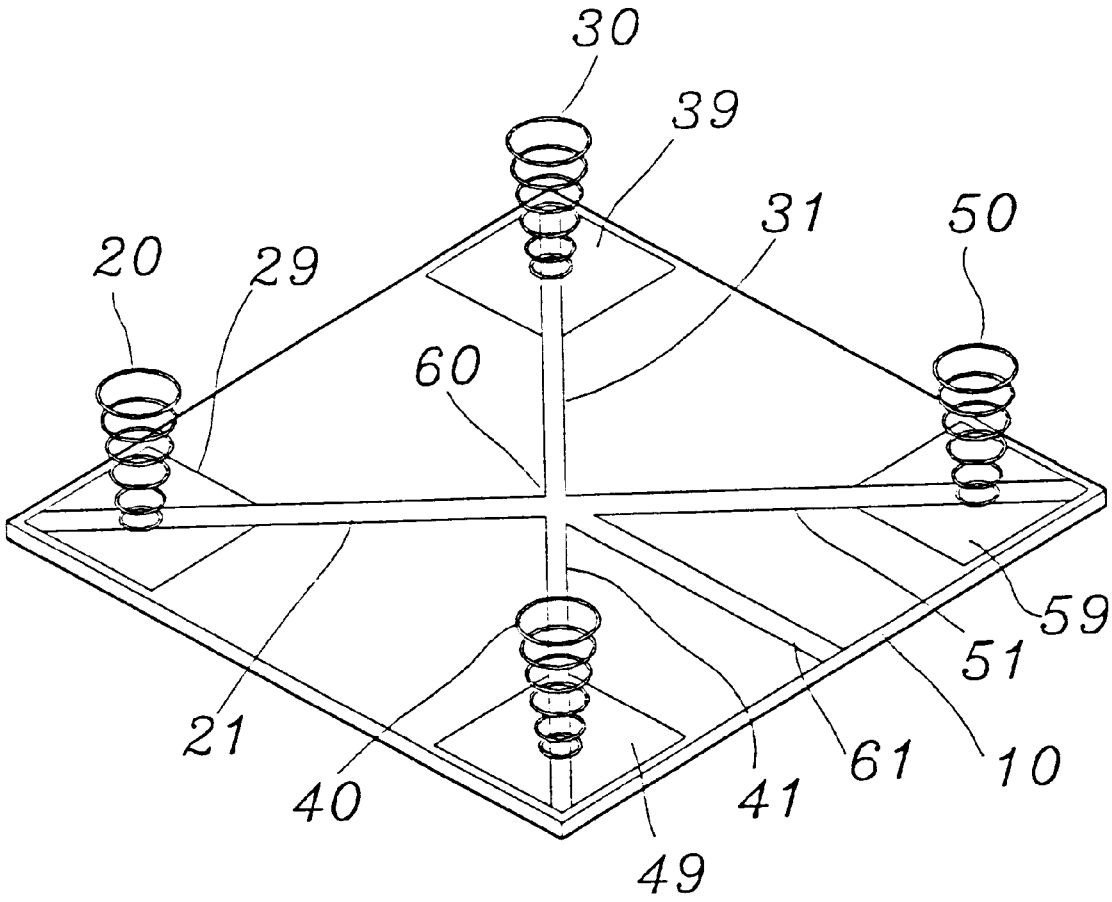
FIG. 1 is a perspective view of a preferred embodiment of the present invention.
Figure 2:
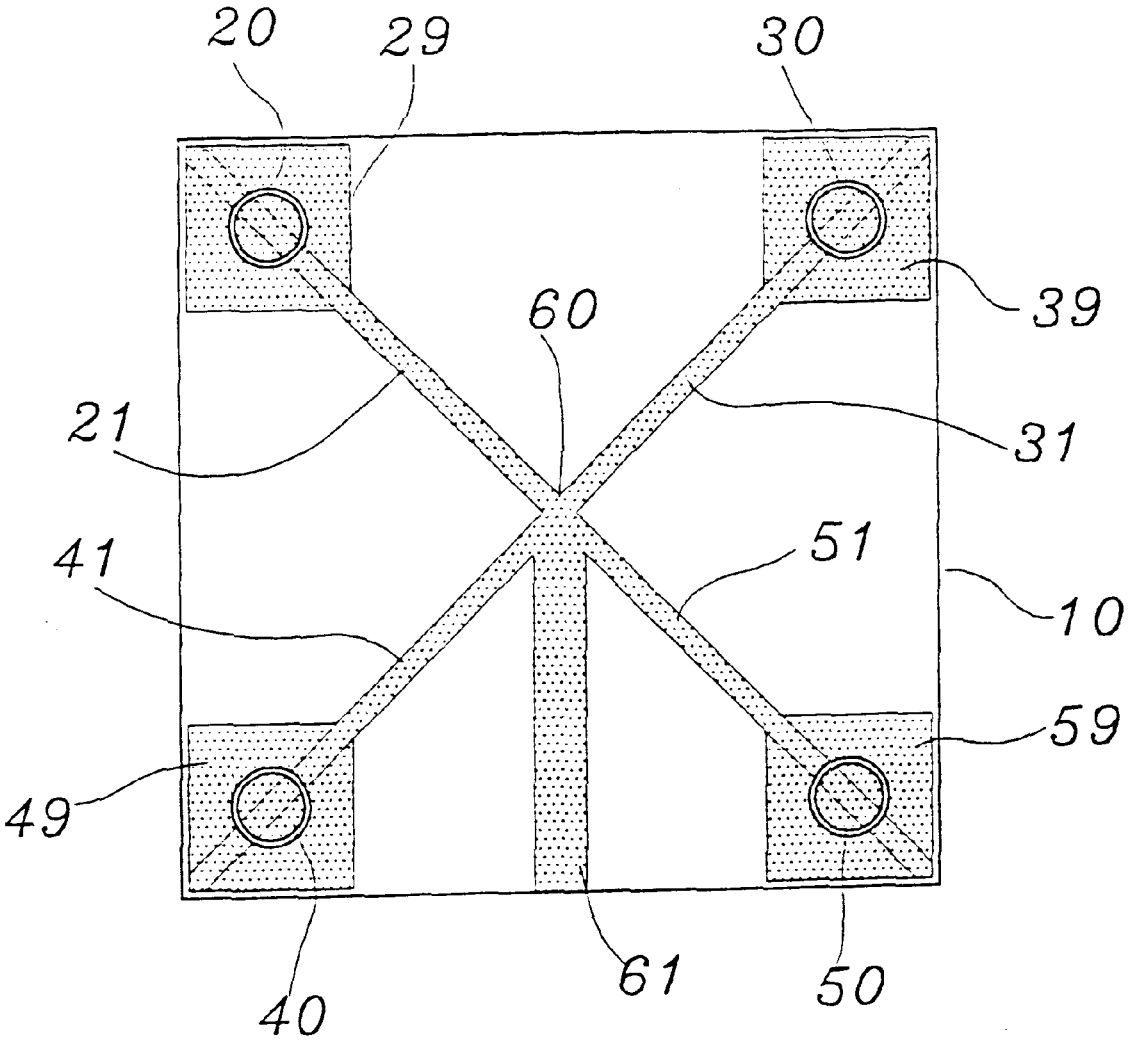
FIG. 2 is a plane view of FIG. 1.

Referring to FIG. 1 and 2, in the preferred embodiment of the present invention, generally it provides a square electric circuit board 10 with the backside thereof grounded. The four orthogonal corners on the surface of the electric circuit board 10 are provided respectively with helical antennae 20, 30, 40 and 50. To prevent disturbance among the antenna, distances between every two helical antennae had better be in the range of 0.25 λ–0.3 λ(wavelength).

One end of each of the helical antennae 20, 30, 40 and 50 (the bottom end in the FIG. 1) is connected respectively with a microstrip line 21, 31, 41 or 51, so that the signals on the helical antennae 20, 30, 40 and 50 can be fed outwardly via the microstrip lines 21, 31, 41 and 51. The microstrip line 21, 31, 41 or 51 functions as an impedance converter, the length thereof is about ¼λ. In the preferred embodiment shown in the drawings, the microstrip lines 21, 31, 41 and 51 intercross diagonally.

The microstrip lines 21, 31, 41 and 51 can be gathered at a point 60, and then the signals are fed outwardly via another microstrip line 61, now, a helical antenna array is completed.

In the preferred embodiment of the present invention, the four corners where the helical antennae 20, 30, 40 and 50 are located can be provided with reflectors 29, 39, 49 and 59 to form four sections to increase the gain of the helical antennae 20, 30, 40 and 50. The reflectors 29, 39, 49 and 59 are preferably made from copper sheets.

Figure 3:
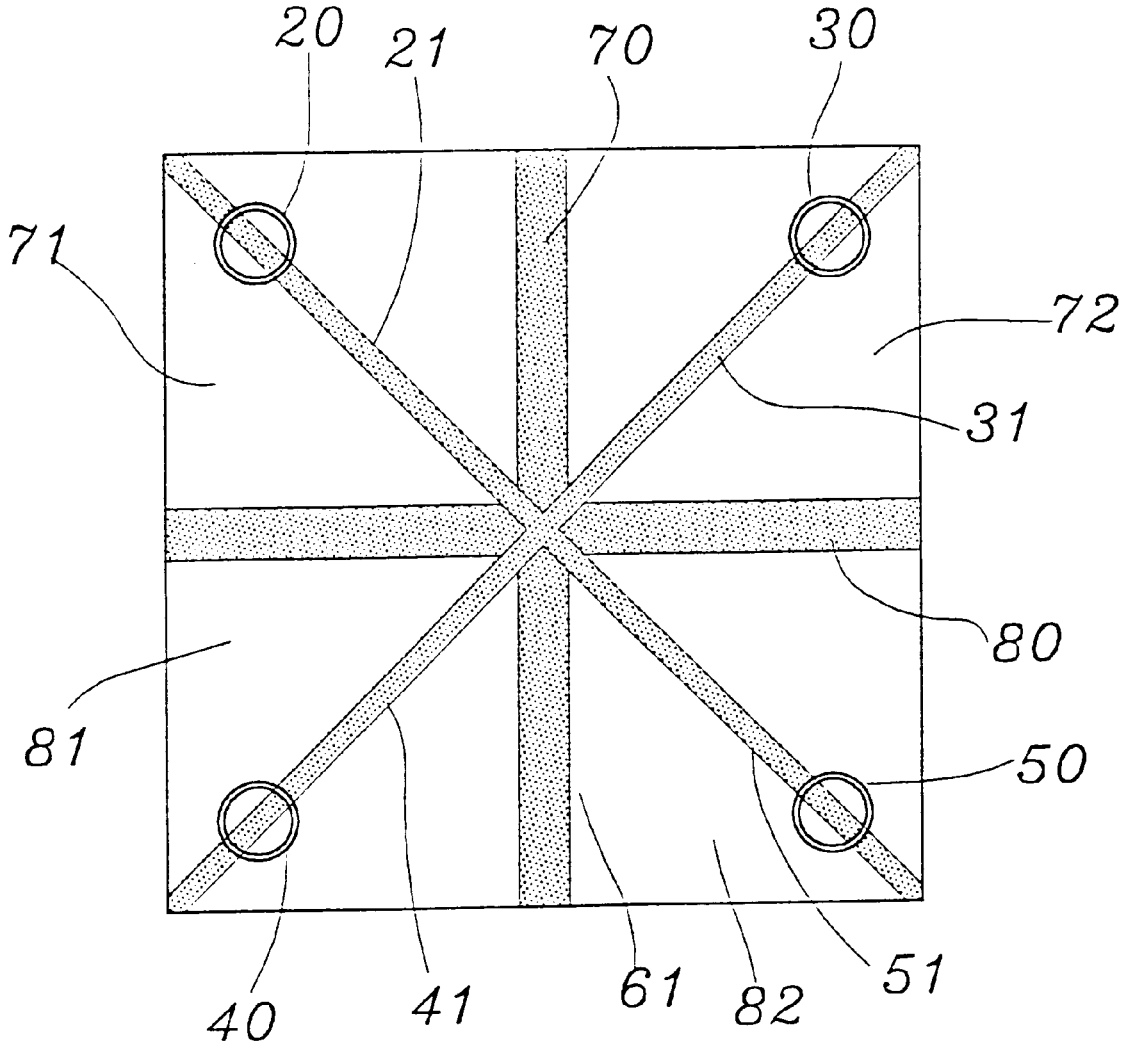
FIG. 3 is a plane view of another preferred embodiment of the present invention.

There is another way to separate the helical antennae 20, 30, 40 and 50 into four sections, as shown in FIG. 3, two copper sheets 70, 80 are intercrossed with each other to form the desired four sections 71, 72, 81 and 82.

When the present invention is mounted in a communication instruments carried on one's own such as a notebook style computer to function as an antenna device, even if one or two of the corners are influenced by other electronic elements or obscuring objects, the antennae at the other corners can still normally function, thereby, the omni-directional broadband signal receiving and emitting functions can be effected, this can thoroughly get rid of the defect of bad or difficult signal receiving or emitting of a helical antenna device mounted in a communication instruments carried on one's own such as a notebook style computer under the complicated interior environment.

The preferred embodiment disclosed above is only for illustrating the present invention. It will be apparent to those skilled in this art that various modifications or changes can be made to the elements of the present invention without departing from the spirit and characteristic of this invention. Accordingly, all such modifications and changes also fall within the scope of the appended claims and are intended to form part of this invention.

What is claimed is:

1. An omni-directional broadband helical antenna array suitable to be mounted in a communication instrument to function under its complicated interior environment as an omni-directional signal receiving and emitting device, said array has a square electric circuit board with the back side thereof grounded, the four orthogonal corners on the surface of said electric circuit board are provided each with a helical antenna, said helical antennas use microstrip lines functioning as impedance converters to feed signals outwardly, and said microstrip lines feed signals outwardly via another microstrip line after gathering said microstrip lines.

2. An omni-directional broadband helical antenna array as defined in claim 1, wherein, distance between every two helical antennas is in the range of 0.25 λ–0.3 λ.

3. An omni-directional broadband helical antenna array as defined in claim 2, wherein, said helical antennas are provided with reflectors to separate said array into four sections.

4. An omni-directional broadband helical antenna array as defined in claim 1, wherein, the length of each of said microstrip lines functioning as an impedance converter of each of said signal outward feeding antennas is ¼ λ.

5. An omni-directional broadband helical antenna array as defined in claim 4, wherein, said helical antennas are provided with reflectors to separate said array into four sections.

6. An omni-directional broadband helical antenna array as defined in claim 1, wherein, said helical antennas are provided with reflectors to separate said array into four sections.

7. An omni-directional broadband helical antenna array as defined in claim 6, wherein, said reflectors are copper sheets.

8. An omni-directional broadband helical antenna array as defined in claim 7, wherein, said copper sheets are located at said four orthogonal corners to form said four sections desired.

9. An omni-directional broadband helical antenna array as defined in claim 7, wherein, said copper sheets are intercrossed with each other to form said four sections desired.

* * * * *